United States Patent [19]

Robaldo

[11] Patent Number: 4,589,662

[45] Date of Patent: May 20, 1986

[54] PLUG FOR DAMPING VIBRATIONS OF TENNIS RACKET CORDS

[76] Inventor: Aldo M. Robaldo, Corso Francia 33, 10138 Turin, Italy

[21] Appl. No.: 666,660

[22] Filed: Oct. 31, 1984

[30] Foreign Application Priority Data

Nov. 16, 1983 [IT] Italy ..... 53.935/83[U]

[51] Int. Cl.[4] ..... A63B 49/00

[52] U.S. Cl. ..... 273/73 D; 273/DIG. 29

[58] Field of Search ..... 273/73 R, 73 D, 73 C, 273/67 R; 124/92; 84/234, 288; 174/42; 173/139; 74/574; 49/9; 73/430

[56] References Cited

U.S. PATENT DOCUMENTS 2,227,528 1/1941 Adler ..... 174/42

3,463,870 8/1969 Eucker ..... 174/42

3,921,979 11/1975 Dischinger ..... 273/73 R 3,991,856 11/1976 Shigeta et al. ..... 174/42

*Primary Examiner*—Richard C. Pinkham

*Assistant Examiner*—Matthew L. Schneider

*Attorney, Agent, or Firm*—James D. Hall

[57] ABSTRACT

A plug for damping vibrations of tennis racket cords comprising a flat parallelepiped body of resilient material provided with a pair of outer channels having laterally open slots to permit the plug to be inserted between the cords and the cords to be connected. The plug also has a pair of parallel inner holes located on the same plane with the axes of the channels and serving to increase the resilience of the material and make the plug adaptable to various types of rackets.

2 Claims, 3 Drawing Figures

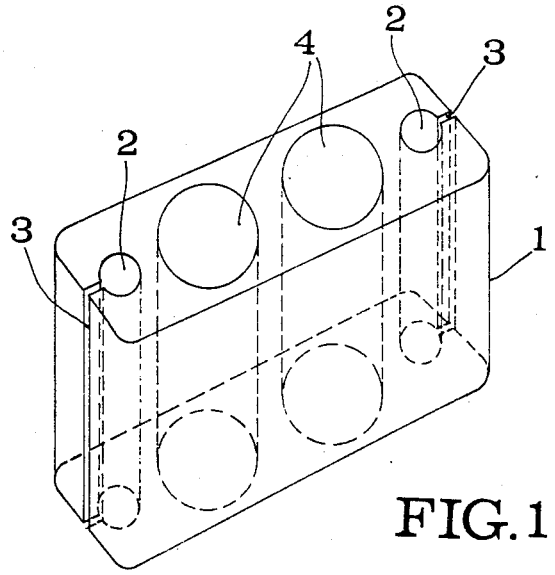
FIG. 1
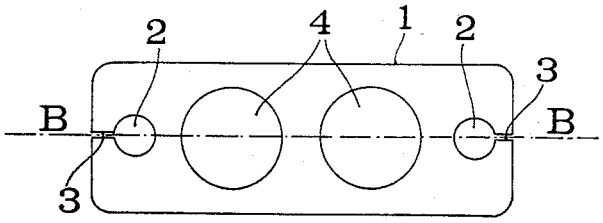
FIG. 2
FIG. 3
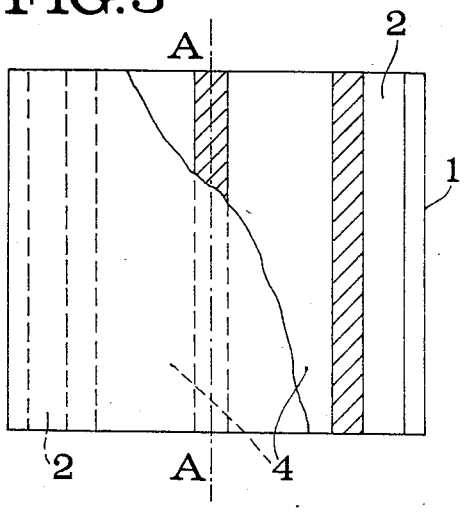

PLUG FOR DAMPING VIBRATIONS OF TENNIS RACKET CORDS

BACKGROUND OF THE INVENTION

This invention relates to a plug for damping vibrations in the resilient cords of tennis rackets.

It is known that when one hits the ball when playing tennis, the cords tend to vibrate due to the strain to which they are subjected. Normally this vibration is of very short duration, but it may happen that the frequency of vibration of the cords coincides with the own frequency of vibration of the frame of the tennis racket and in this case a resonance is produced that amplifies the vibration with deleterious effects well known to tennis players.

At present a device for damping vibrations in the cords of tennis rackets is used which consists in a rubber tab having a pair of lateral holes at the ends and a pair of rubber pins in the middle above and below the rubber tab. For securing the rubber tab to the cords of the racket, the two limbs of the tab are wound around the cords and the pins are inserted in the holes made in the tab.

However, this device is little efficient for damping vibrations in tennis racket cords and it is very difficult to insert it among the cords.

SUMMARY OF THE INVENTION

It is an object of the present invention to eliminate the aforementioned drawbacks by providing a vibration damping plug that can be easily mounted and produced at relatively low cost, this plug comprising a flattened body of parallelepiped geometrical shape and resilient material, preferably silicone rubber, and being provided with a pair of outer channels to permit it to be inserted between the cords and at the same time the cords to be resiliently connected, the plug being further provided with a pair of inner holes whose axes are parallel and located on the same plane with the axes of the channels, the holes serving to increase the resilient effect of the material and make the plug adaptable to various types of rackets.

BRIEF DESCRIPTION OF THE DRAWING

FIG. 1 is a perspective view of a vibration damping plug according to the invention;

FIG. 2 is a top plan view thereof, and

FIG. 3 is a part front view of the plug, partly in section taken on the line B—B in FIG. 2.

DESCRIPTION OF PREFERRED EMBODIMENT

Referring to FIG. 1, a plug 1 according to the invention comprises a flattened body of parallelepiped geometrical shape of resilient material, preferably silicone rubber, provided with a pair of channels 2 extending parallel to the axis A—A in FIG. 3, the channels 2 being formed with a pair of slots 3 to permit the plug 1 to be inserted between the cords of the tennis racket.

A pair of holes 4 extending parallel to the axis A—A in FIG. 3 is provided in the inner portion of the plug 1 to increase the resilience of the plug and at the same time to permit it to be adapted to the correct distance between the cords, a provision which may vary according to the various types of rackets that are at present commercially available.

Although a peferred embodiment of the invention has thus been described in detail and illustrated in the accompanying drawing, it is to be understood that the invention is not limited to this precise embodiment and that numerous changes and modifications obvious to one skilled in the art may be made therein without departing from the scope of the invention as defined by the appended claim.

I claim:

1. A vibration damping plug for tennis racket cords compising a flat one piece body of parallelepiped geometrical shape and resilient material, said body including a pair of outer channel means having parallel axes and a pair of slots to permit the body to be inserted between said cords and thereby resiliently connect the cords, said body further including a pair of inner hole means having parallel axes located in the same plane with the axes of said channel means for increasing the resilient effect of the material to make said body more resilient between said channel means to accommodate various types of tennis rackets.

2. A vibration damping plug for tennis racket cords according to claim 1 wherein said resilient material is silicone rubber.

* * * * *